US008935863B2

(12) United States Patent
Leonard

(10) Patent No.: US 8,935,863 B2
(45) Date of Patent: Jan. 20, 2015

(54) METHOD OF DREDGING A POND

(71) Applicant: Jeremy Leonard, Ardrossan (CA)

(72) Inventor: Jeremy Leonard, Ardrossan (CA)

( * ) Notice: Subject to any disclaimer, the term of this patent is extended or adjusted under 35 U.S.C. 154(b) by 0 days.

(21) Appl. No.: 13/929,502

(22) Filed: Jun. 27, 2013

(65) Prior Publication Data

US 2014/0026449 A1 Jan. 30, 2014

(30) Foreign Application Priority Data

Jul. 30, 2012 (CA) ..... 2784630

(51) Int. Cl.

| | |
|---|---|
| ***G01F 1/00*** | (2006.01) |
| ***E02F 3/88*** | (2006.01) |
| ***E02F 3/90*** | (2006.01) |
| ***E02F 5/28*** | (2006.01) |
| ***E02F 9/20*** | (2006.01) |

(52) U.S. Cl.

CPC ..... *E02F 3/8866* (2013.01); *E02F 3/8808* (2013.01); *E02F 3/8875* (2013.01); *E02F 3/907* (2013.01); *E02F 5/282* (2013.01); *E02F 9/2016* (2013.01)

USPC ..... 37/309; 37/307; 210/747.4

(58) Field of Classification Search

USPC ..... 37/307–346; 210/747.4

See application file for complete search history.

(56) References Cited

U.S. PATENT DOCUMENTS

| | | | | | |
|---|---|---|---|---|---|
| 1,547,949 | A * | 7/1925 | Newsom | 37/317 |
| 3,763,580 | A * | 10/1973 | Kuntz, Jr. | 37/321 |
| 3,924,896 | A * | 12/1975 | Blankenship | 299/18 |
| 4,004,357 | A * | 1/1977 | Faldi | 37/320 |
| 4,451,177 | A | 5/1984 | Goldsmith | |
| 5,412,884 | A * | 5/1995 | Staples et al. | 37/342 |
| 6,041,527 | A * | 3/2000 | Hostetler | 37/345 |
| 6,584,709 | B2 * | 7/2003 | Martel et al. | 37/313 |
| 6,625,907 | B2 * | 9/2003 | Murray et al. | 37/332 |
| 7,083,734 | B2 | 8/2006 | Happonen | |
| 2002/0059740 | A1 * | 5/2002 | Murray et al. | 37/317 |
| 2003/0062319 | A1 * | 4/2003 | Keller et al. | 210/747 |
| 2004/0159614 | A1 * | 8/2004 | Happonen | 210/747 |
| 2005/0016931 | A1 * | 1/2005 | Keller et al. | 210/747 |

FOREIGN PATENT DOCUMENTS

| | | |
|---|---|---|
| CA | 2 730 861 A1 | 8/2011 |
| GB | 2 103 099 A | 2/1983 |

OTHER PUBLICATIONS

Canadian Search Report mailed Dec. 10, 2013, issued in corresponding Canadian Application No. 2,784,630, filed Jul. 30, 2012, 2 pages.

Canadian Search Report mailed Dec. 10, 2013, issued in Canadian Application No. 2,784,850, filed Jul. 30, 2012, 2 pages.

* cited by examiner

*Primary Examiner* — Matthew D Troutman

(74) *Attorney, Agent, or Firm* — Christensen O'Connor Johnson Kindness PLLC

(57) ABSTRACT

A method of dredging a pond uses a submersible assembly, having a dredging cutter and submersible pump, which is submersed in the pond. The submersible assembly is moved along a bottom of the pond by winches. A controller receives signals from a global positioning system as to the position of the submersible assembly in the pond and moves the submersible assembly in a continuous dredging pattern through the coordinated operation of the winches.

3 Claims, 2 Drawing Sheets

METHOD OF DREDGING A POND

FIELD

There is described a method of dredging settling ponds and other small bodies of water.

BACKGROUND

U.S. Pat. No. 6,625,907 (Murray et al.) entitled "Method and apparatus for dredging and transporting dredged solids" describes a method and apparatus for dredging bodies of water. The method uses a barge or other suitable motorized self-contained vessel. The vessel illustrated and used as an example in the Murray et al. patent reference is stated to be one hundred and eighty feet long and fifty four feet wide. One or more dredge shoes are suspended by a first set of cables from booms. The first cables maintain a roughly vertical orientation, subject to some angular variation. There are also second set of cables extending from a riser assembly to the one or more dredge shoes. The riser has a horizontal section that is lowered into the water and positioned proximate to a bottom of a body of water to be dredged so that the cables are maintained in a roughly horizontal orientation. A finite control system is described for repositioning the vessel during dredging using cables and winches and aided by a global positioning system. While the Murray et al. method and apparatus has merit, it is not suitable for use in settling ponds and other small bodies of water. There will now be described a method and associate apparatus that has been developed expressly for the purpose of dredging settling ponds and other small bodies of water.

SUMMARY

There is provided a method of dredging a pond. A first step involves positioning on land at least three winching stations spaced at spaced intervals around a perimeter of a pond. Each winching station includes a winch and a length of cable. A second step involves connecting a remote end of each cable from each winching station to a submersible assembly. The submersible assembly includes a cutter, a submersible pump, and a global positioning system having an antenna that projects above water in the pond. A third step involves connecting to the submersible assembly a power cord to provide power to operate the cutter and submersible pump and a conduit through which the submersible pump can pump cuttings from the cutter. A fourth step involves submersing the submersible assembly in the pond and activating the cutter and submersible pump. A fifth step involves controlling in a coordinated manner the operation of the winches from each winching station through a controller. The controller receives signals from the global positioning system as to the position of the submersible assembly in the pond and moves the submersible assembly in a continuous dredging pattern through the coordinated operation of the winches.

Using the method described above, the controller will operate the submersible assembly in an automated manner without human intervention until a predetermined stop event. After experimenting with various possible continuous dredging patterns, it has been determined that best results may be obtained when the continuous dredging pattern is a generally helical pattern which starts from a central position and moves sequentially outwardly toward the perimeter of the pond. In such case, the predetermined stop event will be reaching the perimeter of the pond. It will be appreciated that the generally helical pattern can be elongated to better suit ponds that are oval or provided with angular turns to form a series of interconnected sequential "squares" or rectangles for manmade settling ponds that are square or rectangular.

It will be appreciated that the above described method is unique as it does not require a floating vessel or floating structure. This aspect significantly reduces the complexity and, consequently, the cost of the dredging system.

It will be appreciated that the above described method facilitates the dredge being operated automatically by a computer controller, so that personnel are only required for set up and removal from the body of water. Using GPS positioning and GPS differential monitoring, the computer can determine the extent of horizontal movement and the extent of vertical movement providing an basis for calculating a volume of material that has been removed.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
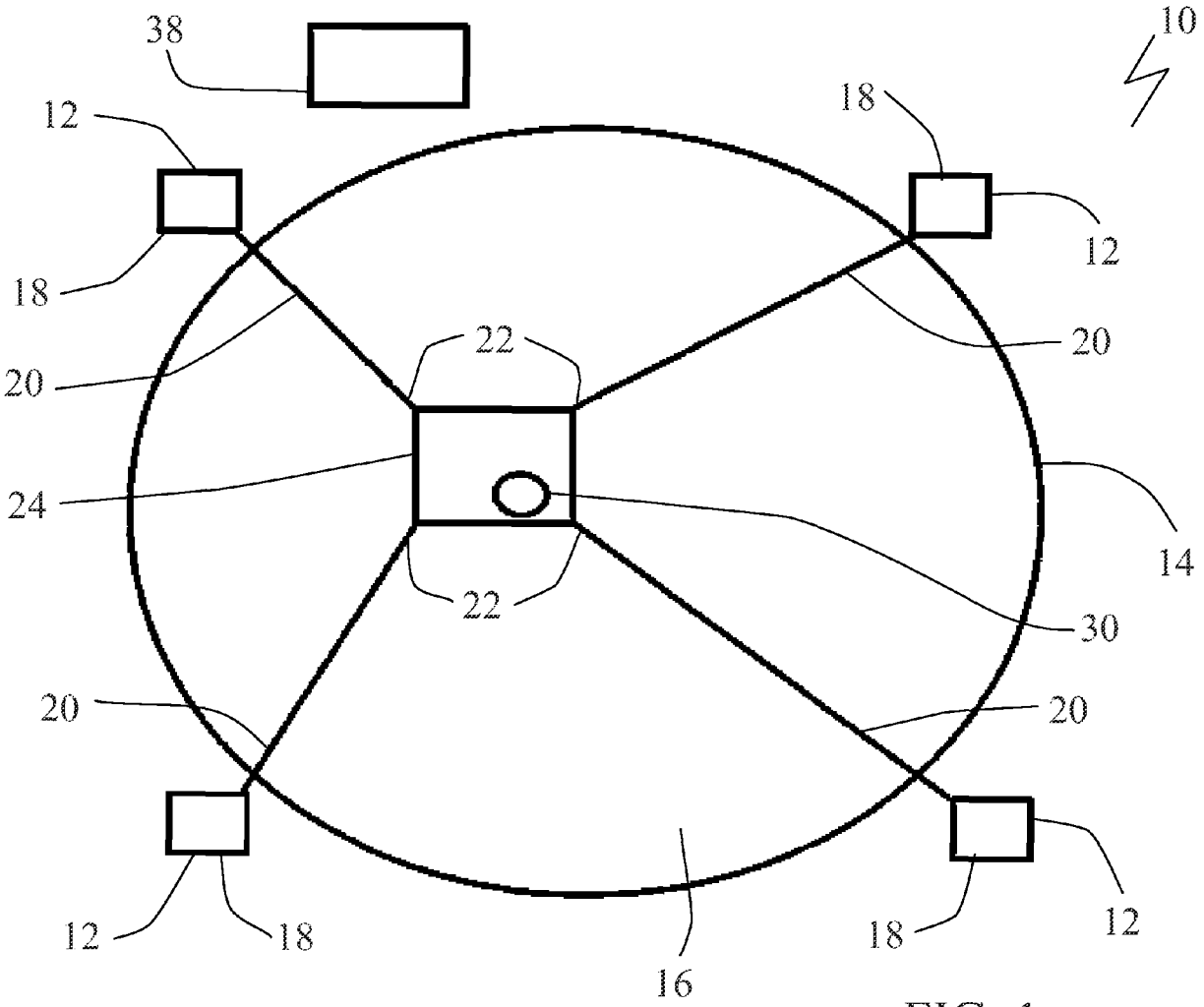
FIG. 1 is a top plan view of a dredging system configured in accordance with the teachings of the present method.

A dredging system generally identified by reference numeral 10, will now be described with reference to FIGS. 1 and 2.

Figure 2:
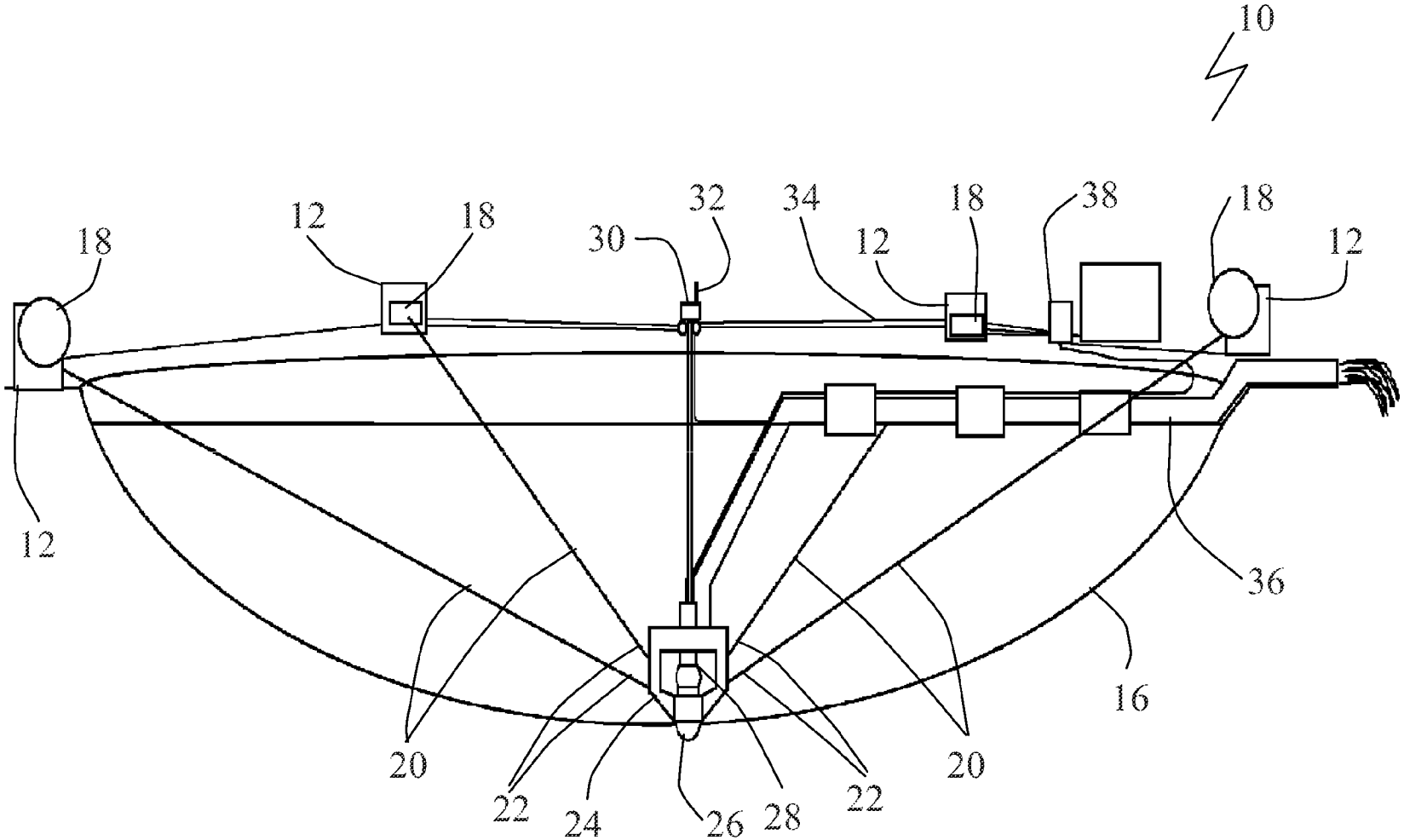
FIG. 2 is a side elevation view, of the dredging system illustrated in FIG. 1.

Structure and Relationship of Parts:

Referring to FIG. 1, dredging system 10 utilizes at least three winching stations 12 positioned on land at spaced intervals around a perimeter 14 of a pond 16. In the embodiment shown, four winching stations 12 are used, however it will be understood that different numbers of winching stations 12 may be used. Winching stations 12 have a winch 18 and a length of cable 20. A remote end 22 of each cable 20 from winching stations 12 are connected to a submersible assembly 24. Referring to FIG. 2, submersible assembly 24 has a cutter 26, a submersible pump 28 and a global positioning system 30 that has an antenna 32 that projects above the water in pond 16. A power cord 34 is connected to submersible assembly 24 to provide power to operate cutter 26, submersible pump 28 and a conduit 36 through which submersible pump 28 can pump cuttings from cutter 26. A controller 38 controls the operation of winches 18 from each winching station 12. Controller 38 receives signals from global positioning system 30 as to the position of submersible assembly 24 in pond 16 and moves submersible assembly 24 in a continuous dredging pattern through coordinated operation of winches 18.

Operation:

Referring to FIG. 1, winching stations 12 are positioned on land at spaced intervals around a perimeter 14 of pond 16. Remote end 22 of each cable 20 from each winching station 12 is connected to submersible assembly 24. Referring to FIG. 2, submersible assembly 24 is connected to power cord 34 which provides power to operate cutter 26, submersible pump 28 and conduit 36 through which submersible pump 28 pumps cuttings from cutter 26. Submersible assembly 24 is submerged in pond 16 and cutter 26 and submersible pump 28 are activated. The operation of winches 18 from each winching station 12 is controlled in a coordinated manner through controller 38. Controller 38 receives signals from global positioning system 30 as to the position of submersible assembly 24 in pond 16 and moves submersible assembly 24 in a continuous dredging pattern through the coordinated operation of winches 18. Beneficial results have been seen when the continuous dredging pattern is a generally helical pattern which starts from a central position and moves sequentially outwardly toward the perimeter 14 of pond 16. It will be understood that different continuous dredging patterns may also be used.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of dredging a pond, comprising:

positioning on land at least three winching stations spaced at spaced intervals around a perimeter of a pond, wherein each winching station comprises a winch and a length of cable;

connecting a remote end of each cable from each winching station to a submersible assembly that comprises a cutter, a submersible pump, and a global positioning system having an antenna that projects above water in the pond;

connecting to the submersible assembly a power cord to provide power to operate the cutter and submersible pump and a conduit through which the submersible pump can pump cuttings from the cutter;

suspending the submersible assembly from the cables below a surface of the pond and activating the cutter and submersible pump; and controlling in a coordinated manner the operation of the winches from each winching station through a controller, the controller receiving signals from the global positioning system as to the position of the submersible assembly in the pond and moving the submersible assembly in a dredging pattern through the coordinated operation of the winches.

2. The method of claim 1, wherein the dredging pattern is a generally helical pattern which starts from a central position and moves sequentially outwardly toward the perimeter of the pond.

3. The method of claim 1, wherein the dredging pattern is a continuous dredging pattern.

* * * * *